US008901831B2

(12) United States Patent
Du et al.

(10) Patent No.: US 8,901,831 B2
(45) Date of Patent: Dec. 2, 2014

(54) CONSTANT CURRENT PULSE-WIDTH MODULATION LIGHTING SYSTEM AND ASSOCIATED METHODS

(71) Applicant: Lighting Science Group Corporation, Satellite Beach, FL (US)

(72) Inventors: George Du, Rockledge, FL (US); Fredric S. Maxik, Indialantic, FL (US); David E. Bartine, Cocoa, FL (US); Robert R. Soler, Cocoa Beach, FL (US)

(73) Assignee: Lighting Science Group Corporation, Melbourne, FL (US)

( * ) Notice: Subject to any disclaimer, the term of this patent is extended or adjusted under 35 U.S.C. 154(b) by 166 days.

(21) Appl. No.: 13/722,581

(22) Filed: Dec. 20, 2012

(65) Prior Publication Data

US 2013/0293108 A1 Nov. 7, 2013

Related U.S. Application Data

(60) Provisional application No. 61/643,726, filed on May 7, 2012.

(51) Int. Cl.

| | |
|---|---|
| ***H05B 37/00*** | (2006.01) |
| ***H05B 33/08*** | (2006.01) |
| ***H05B 37/02*** | (2006.01) |

(52) U.S. Cl.

CPC ..... *H05B 37/02* (2013.01); *H05B 33/083* (2013.01)

USPC ..... 315/185 R; 315/191; 315/307

(58) Field of Classification Search

USPC ..... 315/185 R, 191, 193, 291, 307, 308

See application file for complete search history.

(56) References Cited

U.S. PATENT DOCUMENTS

| | | | |
|---|---|---|---|
| 2,981,827 | A | 12/1956 | Orsatti et al. |
| 4,136,378 | A | 1/1979 | Chevali |
| 4,211,955 | A | 7/1980 | Ray |
| 4,243,934 | A | 1/1981 | Brasfield |
| 4,423,473 | A | 12/1983 | Kirkley |
| 4,455,562 | A | 6/1984 | Dolan et al. |
| D302,863 | S | 8/1989 | Krol |

(Continued)

FOREIGN PATENT DOCUMENTS

| | | |
|---|---|---|
| DE | 10105622 | 8/2002 |
| EP | 0441965 | 8/1991 |

(Continued)

OTHER PUBLICATIONS

U.S. Appl. No. 13/737,581, filed Jan. 2013, Maxik, et al.

(Continued)

*Primary Examiner* — David H Vu

(74) *Attorney, Agent, or Firm* — Mark R. Malek; Daniel C. Pierron; Zies Widerman & Malek

(57) ABSTRACT

A lighting system comprising a constant current power source one or more sets of light emitting elements, and associated circuitry. The light emitting elements may be light emitting diodes (LEDs) that have been selected to emit light having specific wavelengths corresponding to specific colors. The lighting system may selectively control the intensity of each set of LED by utilizing pulse-width modulation. The sets of LEDs may be serially connected and selectively operated independently of each other set of LEDs.

20 Claims, 2 Drawing Sheets

(56) References Cited

U.S. PATENT DOCUMENTS

| | | | |
|---|---|---|---|
| D325,994 | S | 5/1992 | Hume et al. |
| 5,136,483 | A | 8/1992 | Schoniger et al. |
| 5,162,696 | A | 11/1992 | Goodrich |
| 5,175,528 | A | 12/1992 | Choi et al. |
| D336,963 | S | 6/1993 | Levin et al. |
| 5,313,187 | A | 5/1994 | Choi et al. |
| 5,358,880 | A | 10/1994 | Lebby et al. |
| D355,495 | S | 2/1995 | Matsumura et al. |
| 5,439,941 | A | 8/1995 | Butler et al. |
| 5,561,346 | A | 10/1996 | Byrne |
| 5,585,783 | A | 12/1996 | Hall |
| 5,707,132 | A | 1/1998 | Ooki et al. |
| 5,749,646 | A | 5/1998 | Brittell |
| D395,092 | S | 6/1998 | Vakil |
| 5,782,553 | A | 7/1998 | McDermott |
| 5,877,863 | A | 3/1999 | Ross et al. |
| 5,929,788 | A | 7/1999 | Vukosic |
| D414,282 | S | 9/1999 | Kato et al. |
| 5,982,156 | A | 11/1999 | Weimer et al. |
| 6,016,038 | A | 1/2000 | Mueller et al. |
| 6,051,935 | A | 4/2000 | Bucks et al. |
| D426,653 | S | 6/2000 | Ho |
| D427,335 | S | 6/2000 | Noll |
| D433,166 | S | 10/2000 | Noll |
| 6,150,771 | A | 11/2000 | Perry |
| 6,150,774 | A | 11/2000 | Mueller et al. |
| D435,577 | S | 12/2000 | McBride |
| 6,166,496 | A | 12/2000 | Lys et al. |
| 6,184,628 | B1 | 2/2001 | Ruthenberg |
| 6,211,626 | B1 | 4/2001 | Lys et al. |
| 6,220,722 | B1 | 4/2001 | Begemann |
| 6,227,679 | B1 | 5/2001 | Zhang et al. |
| 6,285,119 | B1 | 9/2001 | Sundhar |
| 6,285,139 | B1 | 9/2001 | Ghanem |
| 6,286,969 | B1 | 9/2001 | Kurokawa et al. |
| 6,293,684 | B1 | 9/2001 | Riblett |
| 6,345,903 | B1 | 2/2002 | Koike et al. |
| 6,350,041 | B1 | 2/2002 | Tarsa et al. |
| 6,369,781 | B2 | 4/2002 | Hashimoto et al. |
| 6,371,636 | B1 | 4/2002 | Wesson |
| 6,489,937 | B1 | 12/2002 | Ruvinsky |
| D469,890 | S | 2/2003 | Bobel |
| D470,606 | S | 2/2003 | Bobel |
| D470,608 | S | 2/2003 | Bobel |
| D470,610 | S | 2/2003 | Bobel |
| 6,523,978 | B1 | 2/2003 | Huang |
| 6,547,421 | B2 | 4/2003 | Sugano |
| 6,548,967 | B1 | 4/2003 | Dowling et al. |
| 6,580,228 | B1 | 6/2003 | Chen et al. |
| 6,600,274 | B1 | 7/2003 | Hughes |
| 6,608,453 | B2 | 8/2003 | Morgan et al. |
| 6,621,222 | B1 | 9/2003 | Hong |
| D482,143 | S | 11/2003 | Buschmann et al. |
| 6,659,632 | B2 | 12/2003 | Chen |
| 6,662,489 | B2 | 12/2003 | Spiro et al. |
| 6,674,096 | B2 | 1/2004 | Sommers |
| 6,683,419 | B2 | 1/2004 | Kriparos |
| 6,697,130 | B2 | 2/2004 | Weindorf et al. |
| D487,940 | S | 3/2004 | Buschmann et al. |
| 6,707,247 | B2 | 3/2004 | Murano |
| 6,709,126 | B1 | 3/2004 | Leen |
| 6,709,132 | B2 | 3/2004 | Ishibashi |
| 6,724,156 | B2 | 4/2004 | Fregoso |
| D490,919 | S | 6/2004 | Wiesmeth |
| D491,301 | S | 6/2004 | Chen |
| D493,007 | S | 7/2004 | Rugendyke et al. |
| 6,767,111 | B1 | 7/2004 | Lai |
| D494,687 | S | 8/2004 | Matsui et al. |
| D497,439 | S | 10/2004 | Shaw et al. |
| D498,310 | S | 11/2004 | Gagnon et al. |
| 6,822,397 | B2 | 11/2004 | Kawasaki et al. |
| D500,872 | S | 1/2005 | Foo |
| D501,055 | S | 1/2005 | Packard |
| 6,840,003 | B2 | 1/2005 | Moore |
| 6,883,938 | B1 | 4/2005 | Kohara et al. |
| D505,738 | S | 5/2005 | Buschmann et al. |
| 6,900,781 | B1 | 5/2005 | Mori et al. |
| D508,575 | S | 8/2005 | Buschmann et al. |
| 6,942,360 | B2 | 9/2005 | Chou et al. |
| 6,953,265 | B2 | 10/2005 | Suehiro et al. |
| D514,237 | S | 1/2006 | Buschmann et al. |
| 6,982,518 | B2 | 1/2006 | Chou et al. |
| D516,229 | S | 2/2006 | Tang |
| D525,374 | S | 7/2006 | Maxik et al. |
| D525,379 | S | 7/2006 | Maxik et al. |
| D527,119 | S | 8/2006 | Maxik et al. |
| 7,086,756 | B2 | 8/2006 | Maxik |
| D528,227 | S | 9/2006 | Chou et al. |
| D528,673 | S | 9/2006 | Maxik et al. |
| D529,635 | S | 10/2006 | Johnson |
| D531,740 | S | 11/2006 | Maxik |
| D532,124 | S | 11/2006 | Iwase et al. |
| D532,532 | S | 11/2006 | Maxik |
| D535,038 | S | 1/2007 | Egawa et al. |
| 7,178,941 | B2 | 2/2007 | Roberge et al. |
| D538,950 | S | 3/2007 | Maxik |
| D538,951 | S | 3/2007 | Maxik et al. |
| D538,952 | S | 3/2007 | Maxik et al. |
| D541,957 | S | 5/2007 | Wang |
| D542,425 | S | 5/2007 | Wang |
| D542,943 | S | 5/2007 | Wang |
| D545,457 | S | 6/2007 | Chen |
| D546,980 | S | 7/2007 | Lo |
| D547,466 | S | 7/2007 | Lo |
| D560,286 | S | 1/2008 | Maxik et al. |
| 7,319,293 | B2 | 1/2008 | Maxik |
| 7,367,692 | B2 | 5/2008 | Maxik |
| D570,504 | S | 6/2008 | Maxik et al. |
| D570,505 | S | 6/2008 | Maxik et al. |
| 7,824,065 | B2 | 11/2010 | Maxik |
| 8,004,203 | B2 | 8/2011 | Maxik et al. |
| 8,258,706 | B2 * | 9/2012 | Maruyama et al. ..... 315/119 |
| 8,400,071 | B2 | 3/2013 | Gaines et al. |
| 8,773,038 | B2 * | 7/2014 | Logiudice ..... 315/291 |
| 2001/0024112 | A1 | 9/2001 | Jacobs et al. |
| 2001/0055353 | A1 | 12/2001 | Rybicki et al. |
| 2002/0187570 | A1 | 12/2002 | Fukasawa et al. |
| 2003/0031015 | A1 | 2/2003 | Ishibashi |
| 2003/0072145 | A1 | 4/2003 | Nolan et al. |
| 2003/0090910 | A1 | 5/2003 | Chen |
| 2003/0117803 | A1 | 6/2003 | Chen |
| 2004/0026683 | A1 | 2/2004 | Yamada et al. |
| 2004/0052076 | A1 | 3/2004 | Mueller et al. |
| 2004/0189185 | A1 | 9/2004 | Yotsuya |
| 2004/0222947 | A1 | 11/2004 | Newton et al. |
| 2005/0007304 | A1 | 1/2005 | Gallagher et al. |
| 2005/0099108 | A1 | 5/2005 | Hofmann et al. |
| 2005/0174769 | A1 | 8/2005 | Yong et al. |
| 2005/0248277 | A1 | 11/2005 | Van Bruggen et al. |
| 2006/0002110 | A1 | 1/2006 | Dowling et al. |
| 2006/0132064 | A1 | 6/2006 | Gallagher et al. |
| 2006/0273985 | A1 | 12/2006 | Sun et al. |
| 2007/0062433 | A1 | 3/2007 | Hurwitz |
| 2007/0298372 | A1 | 12/2007 | Pinyayev et al. |
| 2008/0037262 | A1 | 2/2008 | Wesson |
| 2011/0031888 | A1 | 2/2011 | Datta et al. |
| 2011/0068702 | A1 | 3/2011 | Van De Ven et al. |
| 2011/0163682 | A1 * | 7/2011 | Jungwirth ..... 315/192 |
| 2012/0200229 | A1 | 8/2012 | Kunst et al. |
| 2012/0306370 | A1 | 12/2012 | Van De Ven et al. |

FOREIGN PATENT DOCUMENTS

| | | |
|---|---|---|
| EP | 0617092 | 9/1994 |
| EP | 0939429 | 9/1999 |
| FR | 2586844 | 3/1987 |
| GB | 2366610 | 3/1987 |
| GB | 2345954 | 7/2000 |
| JP | 10305453 | 11/1998 |
| JP | 200021209 | 1/2000 |
| JP | 2001243807 | 9/2001 |
| JP | 2001325809 | 11/2001 |
| JP | 2001351402 | 12/2001 |
| JP | WO03059013 | 7/2003 |

(56) References Cited

FOREIGN PATENT DOCUMENTS

| | | |
|---|---|---|
| WO | WO03017320 | 2/2003 |
| WO | WO03034458 | 4/2003 |
| WO | WO2004003869 | 1/2004 |
| WO | WO2005107328 | 11/2005 |

OTHER PUBLICATIONS

European Search Report for European Application No. 10 15 6023; Mailing Date: May 6, 2010; 7 pgs.

Invitation to Pay Additional Fees with Annex (Form PCT/ISA/206) mailed by the European Patent Office on Aug. 3, 2005 in PCT Application No. PCT/US2005/013354, 4 pages.

PCT Search Report (Forms PCT/ISA/220 and 210) and PCT Written Opinion (Form PCT/ISA/237) mailed by the European Patent Office on Oct. 26, 2005 in PCT Application No. PCT/US2005/013354, 16 pages.

Fredric S. Maxik, U.S. Appl. No. 29/214,892, filed Oct. 8, 2004 for "LED Light Bulb".

Fredric S. Maxik, U.S. Appl. No. 29/214,893, filed Oct. 8, 2004 for "LED Light Bulb".

* cited by examiner

CONSTANT CURRENT PULSE-WIDTH MODULATION LIGHTING SYSTEM AND ASSOCIATED METHODS

RELATED APPLICATIONS

The present invention claims the benefit under 35 U.S.C. §119(e) of U.S. Provisional Patent Application Ser. No. 61/643,726 titled Constant Current Pulse-Width Modulation Lighting System and Associated Methods filed May 7, 2012, and is also related to U.S. Provisional Patent Application Ser. No. 61/486,322 titled Variable Load Power Supply, filed on May 15, 2011, and to U.S. Pat. No. 8,004,203 titled Electronic Light Generating Element with Power Circuit, the entire contents of each of which are incorporated herein by reference.

FIELD OF THE INVENTION

The present invention relates to systems and methods for pulse-width modulation of a lighting system.

BACKGROUND OF THE INVENTION

This background information is provided to reveal information believed by the applicant to be of possible relevance to the present invention. No admission is necessarily intended, nor should be construed, that any of the preceding information constitutes prior art against the present invention.

When light emitting elements that emit lights of different colors are illuminated proximately to each other, the emitted lights may mix to produce a combined light that is different from any of the constituent colors. Some color mixing systems employ differently colored light emitting diodes (LEDs) to produce the above referenced color mixing. However, due to the operational constraints imposed by systems employing LEDs, current solutions require at least some of the LEDs to be connected to each other electrically in parallel. Accordingly, there is a long felt need for a system that can enable color mixing while employing serially connected LEDs. Additionally, the current solutions have lacked the ability to sufficiently selectively control the intensity of the individual colors provided by the LEDs. Accordingly, there is a long felt need for a system that also allows for selective control of intensity of the LEDs.

SUMMARY OF THE INVENTION

With the foregoing in mind, embodiments of the present invention are related to a lighting system. The lighting system may employ a constant current power source to selectively illuminate one or more sets of light emitting elements. The light emitting elements may be light emitting diodes (LEDs) that have been selected to emit light having specific wavelengths corresponding to specific colors. The sets of LEDs may be selectively illuminated such that the lighting system may emit light having a wavelength corresponding to a color that corresponds with one of the sets of LEDs, or a combination thereof. Furthermore, the lighting system may selectively control the intensity of each set of LED by utilizing pulse-width modulation to cause the LEDs of each set of LEDs to emit light at a fraction of a maximum intensity of the LED.

DETAILED DESCRIPTION OF THE PREFERRED EMBODIMENT

Figure 1:
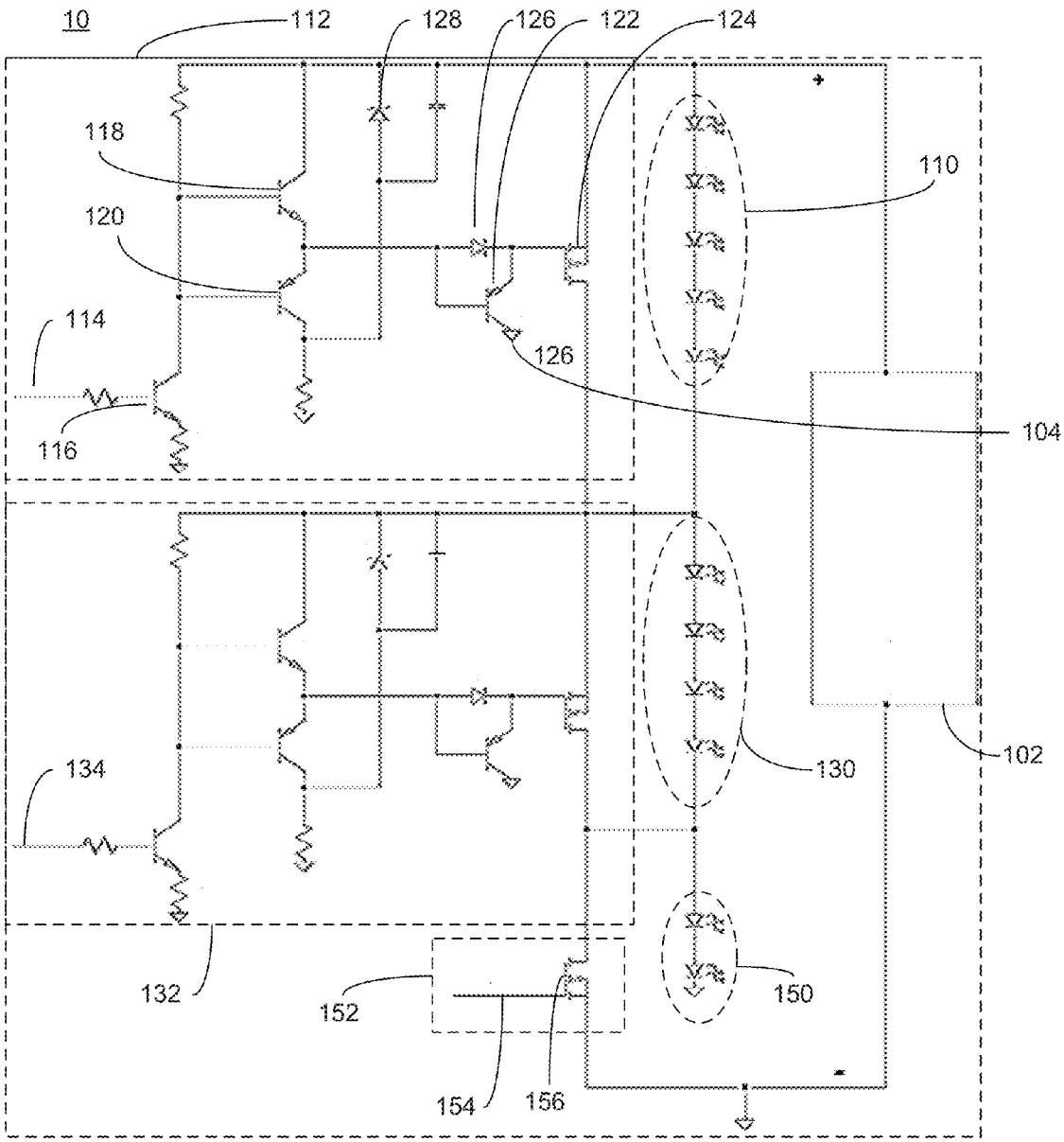
FIG. 1 is a circuit schematic for a lighting system according to an embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

An embodiment of the invention, as shown and described by the various figures and accompanying text, provides a lighting system. The lighting system may include at least one set of light emitting elements. The light emitting elements may be any device or material that can emit light, including, without limitation, light emitting semiconductors. A common type of light emitting semiconductor is a light emitting diode (LED), which may be employed as the light emitting elements in the present embodiment of the invention. Those skilled in the art will appreciate, however, that, although LEDs are predominantly discussed throughout this description, the present invention may be readily used in connection with any other type of light emitting element.

In the present embodiment, the lighting system may include a first set of LEDs, a second set of LEDs, and a third set of LEDs. Each set of LEDs may include any number of LEDs. Furthermore, each set of LEDs may include LEDs that emit light within specific wavelength ranges corresponding to specific colors. The first set of LEDs may include LEDs that emit light having a first wavelength and corresponding color, the second set of LEDs may include LEDs that emit light having a second wavelength and corresponding color, and the third set of LEDs may include LEDs that emit light having a third wavelength and corresponding color.

According to another aspect of the invention, the lighting system may further include circuitry. At least one type of circuitry that may be included is circuitry associated with each set of LEDs. For example, and without limitation, the first set of LEDs may be associated with a first switch circuit, the second set of LEDs may be associated with a second switch circuit, and the third set of LEDs may be associated with a third switch circuit. Each of the first, second, and third switch circuits may be electronically associated with its respective set of LEDs so as to facilitate the functioning of said set of LEDs. Furthermore, each of the first, second, and third switch circuits may be comprised of various electrical and electronic components furthering the functioning of the associated set of LEDs.

The selection of the colors of the LEDs of the various sets of LEDs may be according to a desired color mixing. More specifically, the wavelength of the light emitted by the LEDs of the first set of LEDs may be selected to cooperate with the wavelength of the light emitted by the LEDs of the second set of LEDs to result in a first combined light having a wavelength corresponding to a first combined color. Furthermore, the wavelength of the light emitted by the LEDs of the third set of LEDs may be selected to cooperate with the wavelength of the light emitted by the LEDs of the first or second set of LEDs, or both, to result in a second combined light having a wavelength corresponding to a second combined color. Accordingly, the lighting system may be able to provide light having a wavelength corresponding to the wavelength of light emitted by the first, second, or third sets of LEDs, or any combination thereof. It is contemplated and within the scope of the invention that any number of sets of LEDs having corresponding wavelengths as well as combinations thereof may be employed in the lighting system.

A circuit schematic of an embodiment of the invention is illustrated in FIG. 1. The lighting system 10 includes a first, second, and third set of LEDs 110, 130, 150 as described herein above. Each of the first, second, and third sets of LEDs 110, 130, 150 includes various numbers of LEDs. Furthermore, each of the first, second, and third sets of LEDs 110, 130, 150 includes an associated switch circuit 112, 132, 142, respectively. In the present embodiment, the first and second switch circuits 112, 132 are very similar. Furthermore, the lighting system 10 includes a constant current source 102 and a ground 104 that may be connected at various points in the lighting system.

Furthermore, the lighting system may be configured to control the intensity of each wavelength of the sets of LEDs. In the present embodiment, pulse-width modulation may be employed to illuminate the LEDs of the first, second, and third sets of LEDs to a desired fraction of a maximum intensity of the set of LEDs.

The first switch circuit 112 includes a control input 114. The control input 114 may be configured to selectively turn the first set of LEDs 110 on and off. In the present embodiment, the control input 114 utilizes pulse-width modulation to control the delivery of power to the first set of LEDs 110. The control input 114 may be in either a high state or a low state. Furthermore, the first switch circuit 110 may further include transistors 116, 118, 120, 122, 124 and diodes 126, 128 that are operably associated with the control input 114. More specifically, transistor 124 may be a p-type metal-oxide semiconductor field-effect transistor (MOSFET). Each of the transistors 116, 118, 120, 122, 124 and diodes 126, 128 may be either on or off.

When the control input 114 is in a high state, it causes transistor 116 to turn on. When transistor 116 turns on, transistor 118 turns off, thereby turning on transistor 122. When transistor 122 is turned on, it may cause a short between the gate of transistor 124 and the ground 104, causing the gate charge of transistor 124 to be removed. The removal of the gate charge turns on transistor 124, thereby permitting the free flow of current through transistor 124, functionally turning off the first set of LEDs 110.

When the control input 114 is in a low state, transistor 114 is turned off. In turn, transistor 118 is turned on, permitting a flow of electricity through diode 126 to the gate of transistor 124, thereby preventing the flow of electricity therethrough. Additionally, when transistor 114 is turned off, transistor 120 is similarly turned off, preventing current from flowing therethrough. Due to a lack of alternative paths to ground, current may then flow through the first set of LEDs 110. Therefore, when control input 114 is in a low state, the first set of LEDs 110 is illuminated.

Additionally, the diode 128 may be a zener diode, such that the gate voltage of transistor 124 may be limited to the breakdown voltage of diode 128. In some embodiments, the breakdown voltage may be about 4.7 volts.

The second switch circuit 132 may include the same component parts as the first switch circuit 112 and may be configured to operate essentially identically. Therefore, when control input 134 is in a high state, the second set of LEDs 130 may be turned off, and when the control input 134 is in a low state, the second set of LEDs 130 may be turned on. Moreover, the current supplied to the second set of LEDs 130 and the second switch circuit 132 may be supplied either through transistor 124 or the first set of LEDs 110.

The third switch circuit 152 may include a control input 154 and a transistor 156 that may be an n-type MOSFET. When the control input 154 is in a high state, it turns on transistor 156, thereby permitting a flow of current therethrough and turning off the third set of LEDs 150. When the control input 154 is in a low state, transistor 156 is turned off, thereby causing current to flow through the third set of LEDs 150, thus illuminating them.

It is appreciated that a lighting fixture may include any number of sets of LEDs as well as associated switch circuits. Furthermore, additional switch circuits may be identical or substantially similar to the makeup and operation of the first and second switch circuits 112, 132.

Each of the control inputs 114, 134, 154 may be electrically connected to a controller. The controller may selectively and individually cause the control inputs 114, 134, 154 to be set to a high state or a low state according to the desired operation of the lighting system.

The first set of LEDs 110, as well as the second and third set of LEDs 130, 150 are serially connected, thereby causing a voltage drop both between each LED of the sets of LED as well as across the entire set of LEDs. Furthermore, each set of LEDs 110, 130, 150 is serially connected with each other. Therefore, the voltage of the power being delivered to each set of LEDs may be different. Moreover, due to the fact that at least one of the first, second, and third sets of LEDs 110, 130, 150 may be selectively turned on or off, the voltage necessary to illuminate the first, second, and third sets of LEDs 110, 130, 150 will change and be unknown. If the lighting system employed a constant voltage power source, the required voltage would have to be known. Therefore the sets of LEDs could not be in serial connection. The unknown voltage is compensated for by the constant current source 102. The constant current source 102 is configured to be able to provide power at a varying voltage while maintaining a constant current. Therefore, despite the varying voltage drop across the lighting system 10, the lighting system 10 is able to provide power of sufficient voltage to the sets of LEDs 110, 130, 150 while maintaining a serial connection there between.

Figure 2:
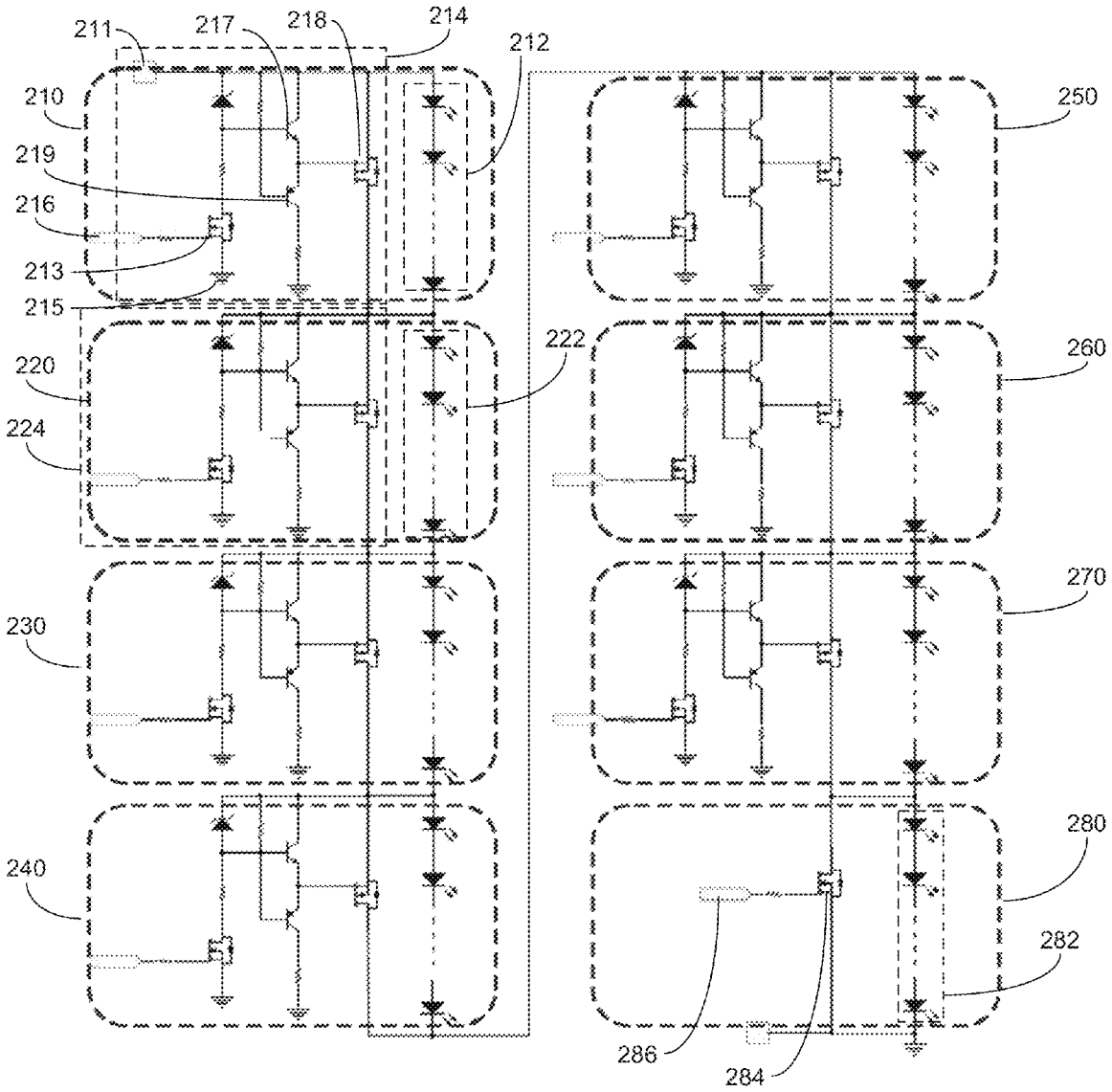
FIG. 2 is a circuit schematic for a lighting system according to another embodiment of the present invention.

Referring now to FIG. 2, another embodiment of the invention is disclosed. The embodiment shown in FIG. 2 includes a lighting system 200 comprising a first channel 210, a second channel 220, a third channel 230, a fourth channel 240, a fifth channel 250, a sixth channel 260, a seventh channel 270, and an eighth channel 280. While eight channels are disclosed in the present embodiment, any number of channels is contemplated and included within the scope of the invention. Each of the channels may be configured in serial electrical connection with each other.

Each of the channels may include a set of LEDs and an associated switch circuit similar to the embodiment disclosed in FIG. 1. For example, the first channel 210 may include a set of LEDs 212 and a switch circuit 214. In the instance of the first channel 210, there may further be included a constant current power source 211. The switch circuit 214 may be in parallel with the set of LEDs 212. The switch circuit 214 may receive a control input 216 that controls the operation of the set of LEDs 212. Furthermore, the switch circuit 214 may include a first MOSFET 218, for instance, a P-channel MOSFET configured in parallel with the set of LEDs 212, wherein each of the first MOSFET 218 and the set of LEDs 212 are electrically connected to the constant current power source 211 and the second channel 220. Additionally, the switch circuit may further include a second MOSFET 213 positioned such that the control input 216 provides the gate charge for second MOSFET 213, which may be an N-channel MOSFET, as well as transistors 217 and 219.

When the control input 216 is in a first state, for instance, a high state, it may provide a voltage above the threshold voltage for the second MOSFET 213, causing the second MOSFET 213 to go into active mode, establishing a route to a ground 215. This may cause or otherwise affect the removal of any charge from the bases of transistors 217 and 219. This may cause transistor 217 to go into inactive mode, preventing the flow of current therethrough, and cause transistor 219 to go into active mode, establishing another route to ground 215, thereby preventing a voltage from being applied to the gate of the first MOSFET 218. Accordingly, the first MOSFET 218 will be in an active state, thereby permitting the free flow of current therethrough, thereby preventing the flow of current through the set of LEDs 212.

Conversely, when the control input 216 is in a second state, for instance a low state, the second MOSFET 213 is in an inactive state, thereby causing transistor 217 to got into an active state, causing a voltage to be applied to the gate of the first MOSFET 218, preventing the flow of current therethrough, thereby enabling the flow of current through the set of LEDs 212, causing them to emit light. Regardless of whether the control input 216 is in a high or low state, current may be provided to the second channel 220 through one of the first MOSFET 218 and the set of LEDs 212, whichever currently has current flowing therethrough.

The second channel 220 may similarly include a set of LEDs 222 and a switch circuit 224 configured to include similar components and have similar modes of operation. Each of the set of LEDs 222 and the switch circuit 224 may be serially connected to the first channel 210. Moreover, all of those channels except for the last in the series may be similarly configured.

The eighth channel 280 may be similarly configured to the third switch circuit 152 of and the third set of LEDs 150 of FIG. 1, namely, comprising a set of LEDs 282 and a single MOSFET 284, such as a P-type MOSFET, having a control input 286 electrically coupled to its gate, such that when the control input 286 is in a first state, for instance a high state, the MOSFET 284 may be in an active state, thereby preventing the set of LEDs 282 from operating. Conversely, when the control input 286 is in a second state, for instance a low state, the MOSFET 284 may be in an inactive state, thereby causing current to flow through the set of LEDs 282, causing them to illuminate.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

What is claimed is:

1. A lighting circuit comprising:

a constant current power source;

a first set of light-emitting elements electrically coupled with the constant current power source;

a first drive circuit electrically coupled to the first set of light-emitting elements in parallel;

a second set of light-emitting elements serially electrically coupled to each of the first set of light-emitting elements and the first drive circuit; and a second drive circuit serially electrically coupled to each of the first set of light-emitting elements and the first drive circuit and electrically coupled to the second set of light-emitting elements in parallel;

wherein the first drive circuit is configured to receive a first control input;

wherein the first drive circuit is configured to operate the first set of light-emitting elements responsive to the first control input;

wherein the second drive circuit is configured to receive a second control input;

wherein the second drive circuit is configured to operate the second set of light-emitting elements responsive to the second control input;

wherein the first drive circuit is configured such that electricity will flow to each of the second set of light-emitting elements and the second drive circuit through the first drive circuit when the first control input is in a first state, and through the first set of light-emitting elements when the control input is in a second state.

2. A lighting circuit according to claim 1 wherein each of the first control input and the second control input are a pulse-width modulation signal.

3. A lighting circuit according to claim 1 wherein a light-emitting element of the first and second sets of light-emitting elements is a light-emitting diode.

4. A lighting circuit according to claim 1 wherein the light-emitting elements of the first set of light-emitting elements emits light having a first wavelength, and wherein the light-emitting elements of the second set of light-emitting elements emit light having a second wavelength.

5. A lighting circuit according to claim 4 wherein the first wavelength is different from the second wavelength.

6. A lighting circuit according to claim 1 wherein the first state of the first control signal is one of a high state and a low state, and wherein the second state of the first control signal is the opposite.

7. A lighting circuit according to claim 1 wherein at least one of the first drive circuit and the second drive circuit comprises a zener diode electrically coupled in parallel with the respective set of light-emitting elements, the zener diode being selected to have a breakdown voltage of approximately 4.7 volts.

8. A light circuit according to claim 1 wherein the first drive circuit comprises a first metal-oxide semiconductor field-effect transistor (MOSFET) electrically coupled to the first set of light-emitting elements in parallel; and wherein each of the second drive circuit and the second set of light-emitting elements are serially electrically coupled with the first MOSFET.

9. A lighting circuit according to claim 1 wherein the first set of light-emitting elements has a peak operational efficiency voltage that is greater than a peak operational efficiency voltage of the second set of light-emitting elements.

10. A lighting circuit according to claim 1 further comprising:

a third set of light-emitting elements serially electrically coupled to each of the second set of light-emitting elements and the second drive circuit; and a third drive circuit serially electrically coupled to each of the second set of light-emitting elements and the second drive circuit and electrically coupled to the third set of light-emitting elements in parallel;

wherein the third drive circuit is configured to receive a third control input;

wherein the third drive circuit is configured to operate the third set of light-emitting elements responsive to the third control input; and wherein the second drive circuit is configured such that electricity will flow to each of the third set of light-emitting elements and the third drive circuit through the second drive circuit when the second control input is in a first state, and through the second set of light-emitting elements when the control input is in a second state.

11. A lighting circuit according to claim 9 wherein the light-emitting elements of the first set of light-emitting elements emits light having a first wavelength; wherein the light-emitting elements of the second set of light-emitting elements emit light having a second wavelength; and wherein the light-emitting elements of the third set of light-emitting elements emit light having a third wavelength; wherein the first wavelength is different from each of the second wavelength and the third wavelength; and wherein the second wavelength is different from the third wavelength.

12. A light circuit according to claim 9 wherein the second drive circuit comprises a second MOSFET electrically coupled to the first set of light-emitting elements in parallel; and wherein each of the third drive circuit and the third set of light-emitting elements are serially electrically coupled with the second MOSFET.

13. A lighting circuit according to claim 9 wherein the third drive circuit comprises a third MOSFET electrically coupled to the third set of light-emitting elements in parallel.

14. A lighting circuit according to claim 9 wherein the second set of light-emitting elements has a peak operational efficiency voltage that is greater than a peak operational efficiency voltage of the third set of light-emitting elements.

15. A method of operating a lighting circuit comprising a constant current power source, a first drive circuit, a first set of light-emitting elements, a second drive circuit, and a second set of light-emitting elements, the method comprising the steps of:

operating the power source to provide current to each of the first drive circuit and the first set of light-emitting elements;

transmitting a first control input to the first drive circuit;

operating the first set of light-emitting elements responsive to the first control input;

transmitting current to each of the second drive circuit and the second set of light-emitting elements through only one of the first drive circuit and the first set of light-emitting elements;

transmitting a second control input to the second drive circuit; and operating the second set of light-emitting elements responsive to the second control input.

16. A method according to claim 15 wherein at least one of the first control input and the second control input comprise a pulse width modulation (PWM) signal.

17. A method according to claim 15 wherein the first drive circuit further comprises a zener diode electrically coupled to the first set of light-emitting elements in parallel and having a breakdown voltage, wherein the first set of light-emitting elements have a breakdown voltage greater than the breakdown voltage of the zener diode, the method further comprising the steps of:

operating the power source to provide current having voltage exceeding the breakdown voltage of each of the zener diode and the first set of light-emitting elements; and causing the zener diode to break down, causing the current to bypass the first set of light-emitting elements.

18. A method according to claim 15 wherein the first drive circuit further comprises a first metal-oxide semiconductor field-effect transistor (MOSFET) electrically coupled to the first set of light-emitting elements in parallel, and wherein the step of operating a first set of light-emitting elements responsive to the first control input further comprises the steps of:

receiving the first control signal; and operating the first MOSFET responsive to the first control signal;

wherein the first control signal being in a high state causes the MOSFET to turn on, thereby causing the first set of light-emitting elements to not operate; and wherein the first control signal being in a low state causes the MOSFET to turn off, thereby causing the first set of light-emitting elements to operate.

19. A method according to claim 15 wherein the lighting circuit further comprises a third drive circuit and a third set of light-emitting elements, the method further comprising the steps of:

transmitting current to each of the third drive circuit and the third set of light-emitting elements through only one of the second drive circuit and the second set of light-emitting elements;

transmitting a third control input to the third drive circuit; and operating the third set of light-emitting elements responsive to the third control input.

20. A method according to claim 19 wherein the third drive circuit comprises a MOSFET, and wherein the step of operating the third set of light-emitting elements responsive to the third control input comprises the steps of:

receiving the third control input at the MOSFET of the third drive circuit; and operating the MOSFET of the third drive circuit responsive to the third control signal;

wherein the third control signal being in a high state causes the MOSFET of the third drive circuit to turn on, thereby causing the first set of light-emitting elements to not operate; and wherein the third control signal being in a low state causes the MOSFET of the third drive circuit to turn off, thereby causing the first set of light-emitting elements to operate.

* * * * *